US007388516B2

(12) United States Patent
Yokota et al.

(10) Patent No.: US 7,388,516 B2
(45) Date of Patent: Jun. 17, 2008

(54) MOBILE APPARATUS

(75) Inventors: Koichi Yokota, Kawasaki (JP); Hiroshi Yamada, Kawasaki (JP); Hideyuki Motoyama, Kawasaki (JP); Jun Kawai, Kawasaki (JP); Satoshi Kazama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 198 days.

(21) Appl. No.: 11/221,887

(22) Filed: Sep. 9, 2005

(65) Prior Publication Data

US 2006/0261978 A1 Nov. 23, 2006

(30) Foreign Application Priority Data

May 18, 2005 (JP) ..... 2005-145924

(51) Int. Cl.
*G08G 1/01* (2006.01)
*G08G 1/123* (2006.01)

(52) U.S. Cl. ..... 340/933; 340/988; 340/995.1; 340/995.17; 340/995.25; 340/435; 340/436; 455/404.1

(58) Field of Classification Search ..... 340/933, 340/988, 995.1, 995.17, 995.25, 435, 436; 455/404.1, 404.2, 403, 556.2
See application file for complete search history.

(56) References Cited

U.S. PATENT DOCUMENTS

| | | | | |
|---|---|---|---|---|
| 6,590,495 | B1 * | 7/2003 | Behbehani | 340/435 |
| 6,963,657 | B1 * | 11/2005 | Nishigaki et al. | 382/106 |
| 7,095,336 | B2 * | 8/2006 | Rodgers et al. | 340/903 |
| 2007/0085993 | A1 * | 4/2007 | Brown, Jr. | 356/3 |

FOREIGN PATENT DOCUMENTS

| | | | |
|---|---|---|---|
| JP | 9-257824 | A | 10/1997 |
| JP | 2000-250434 | A | 9/2000 |
| JP | 2001-272413 | A | 10/2001 |

* cited by examiner

*Primary Examiner*—Toan N. Pham
(74) *Attorney, Agent, or Firm*—Arent Fox LLP.

(57) ABSTRACT

A mobile apparatus senses without failing an object which exists in a traveling direction of itself even when a pedestrian is moving while looking at a screen on which information is displayed. The mobile apparatus having the screen comprises an object detector part 17 which exits within a predetermined range centered around the traveling direction of itself, an acceleration detector part 16 and the detection range changing means for changing a range in which the object detector part 17 detects the existence of an object, the traveling direction of itself is calculated based on acceleration of itself, and based on thus calculated traveling direction of itself, the detection range changing means changes the range in which the object detector part 17 detects the existence of an object.

20 Claims, 6 Drawing Sheets

MOBILE APPARATUS

CROSS-REFERENCE TO RELATED APPLICATIONS

This Nonprovisional application claims priority under 35 U.S.C.§119(a) on Patent Application No. 2005-145924 filed in Japan on May 18, 2005, the entire contents of which are hereby incorporated by reference.

BACKGROUND OF THE INVENTION

The invention relates to a mobile apparatus with which it is possible for a user to detect the existence of an object which exists in a traveling direction of itself while looking at a screen which displays information.

Mobile apparatuses such as mobile telephones and PDAs (Personal Digital Assistant) are widely used these days, and their functions are diverse. Depending on an application therefore, a use may need to operate a mobile apparatus while walking and looking at information which is displayed on a screen.

When one is concentrated on an indication shown on the screen while walking, he can not confirm what is ahead of him. Unable to confirm with his eyes the existence of an object such as other people and a bicycle while operating the mobile apparatus, he is exposed to danger that he collides with an object which exists in a traveling direction of itself, falls and gets hurt. To avoid such danger, it is necessary for him to detect the existence of an object which exists in the traveling direction of itself while walking.

The three-dimensional angle of a mobile apparatus largely changes depending upon how the mobile apparatus is held. For example, Japanese Patent Application Laid-Open Gazette No. 2000-250434 discloses portable information equipment which detects the direction of gravity acting on information displaying means which varies depending upon how the portable information equipment is held, and changes the direction in which information is displayed. Meanwhile, Japanese Patent Application Laid-Open Gazette No. 2001-272413 discloses an example of using a mobile telephone as an acceleration sensor or angular speed sensor.

BRIEF SUMMARY OF THE INVENTION

The present invention has been made in light of the above, and accordingly aims at providing a mobile apparatus which detects without failing an object which exists in a traveling direction of itself even when a pedestrian is moving while looking at a screen on which information is displayed.

To achieve the object, a mobile apparatus including a screen on which information is displayed according to a first invention comprises an object detector part for detecting an object which exists within a predetermined range based on a traveling direction of itself, an acceleration detector part for detecting acceleration of itself and a detection range changing part for changing a range in which the object detector part detects the existence of an object, wherein the traveling direction of itself is calculated based on acceleration of itself detected by the acceleration detector part, and the detection range changing part changes the range in which the object detector part detects the existence of an object based on thus calculated traveling direction of itself.

A mobile apparatus according to a second invention is characterized in that the object detector part is disposed to the back side of a surface which mounts the screen on which information is displayed in the first invention.

A mobile apparatus according to a third invention is characterized in that the object detector part comprises a generator device for emitting a wave, means for acquiring a reflected wave of the wave emitted by this device and means for determining whether an object exists or not based on a period of time since emission of the wave until acquisition of the reflected wave, and the detection range changing part changes the direction in which the wave is emitted in the first or the second invention.

A mobile apparatus according to a fourth invention is characterized in that the object detector part comprises an imaging device for capturing an image, means for analyzing a captured image and means for determining whether an object exists or not based on the result of analysis of the image, and the detection range changing part changes the direction in which the imaging device captures images in the first or the second invention.

A mobile apparatus according to a fifth invention is characterized in that means for calculating a horizontal direction component based on acceleration of itself detected by the acceleration detector part is disposed in any one of the first through the fourth inventions.

A mobile apparatus according to a sixth invention is characterized in that a gyro sensor for measuring the rotating speed of an object is disposed and that the horizontal direction is calculated in the fifth invention.

A mobile apparatus according to a seventh invention is characterized in that the acceleration detector part comprises means for determining whether acceleration of itself detected by the acceleration detector part is larger than a predetermined value and means for activating the object detector part and the detection range changing part in case that the earlier means determines that the acceleration is larger than the predetermined value but stops operations of the object detector part and the detection range changing part in case that the earlier means determines that the acceleration is equal to or smaller than the predetermined value in the fifth or the sixth invention.

A mobile apparatus according to an eighth invention is characterized in that means for outputting an output indicative of the existence of an object in case that the object detector part has detected the existence of the object in any one of the fifth through the seventh inventions.

The first invention comprises: object detecting means for detecting an object which exists within a predetermined range centered around a traveling direction of itself; acceleration detecting means for detecting acceleration of itself; and detection range changing means for changing a range in which the object detecting means detects the existence of an object, the traveling direction of itself is calculated based on acceleration of itself detected by the acceleration detecting means, and the detection range changing means changes the range in which the object detecting means detects the existence of an object based on thus calculated traveling direction of itself. Hence, in the event that a user is walking while looking at the screen on which information is displayed, however the three-dimensional position of the mobile apparatus becomes along three axial directions which are orthogonal to each other, it is possible to detect without failing the traveling direction of itself in which the user is walking, and as the direction of detecting the existence of an object is adjusted and made coincide with the traveling direction of itself, it is possible to detect without failing an object which exists within the predetermined range centered around the traveling direction of itself. This makes it possible to recognize the existence of an object, i.e., an obstacle ahead, and therefore, to obviate danger of injury owing to collision, fall, etc.

In the second invention, the object detecting means is disposed to the back side of a surface which mounts the screen on which information is displayed. Hence, a pedestrian can detect the existence of an object which exists in the traveling direction of itself while looking at the screen on which information is displayed.

In the third invention, the object detecting means emits a wave, acquires a reflected wave of the emitted wave and determines whether an object exists or not based on a period of time since emission of the wave until acquisition of the reflected wave, and the detection range changing means changes the direction in which the wave is emitted. Hence, as the direction of emission of the wave which may be an ultrasonic wave for example is adjusted and made coincide with the traveling direction of itself, it is possible to detect the existence of an object which exists in the traveling direction of itself.

In the fourth invention, the object detecting means comprises imaging means capturing an image, analyzes a captured image and determines whether an object exists or not, and the detection range changing means changes the direction in which the imaging means captures images. Hence, as the direction of a lens of the imaging means for instance is adjusted and made coincide with the traveling direction of itself, it is possible to detect the existence of an object which exists in the traveling direction of itself.

In the fifth invention, a horizontal direction component is calculated based on acceleration of itself detected by the acceleration detecting means. Hence, it is possible to accurately extract the horizontal direction component of the detected acceleration of itself and precisely calculate the traveling direction of itself.

The sixth invention comprises a gyro sensor for measuring the rotating speed of an object, and the direction of gravity acceleration is calculated. As the direction of gravity acceleration is precisely specified therefore, it is possible to accurately extract the horizontal direction component of the detected acceleration of itself and precisely calculate the traveling direction of itself.

In the seventh invention, whether the acceleration of itself detected by the acceleration detecting means is larger than a predetermined value is determined, and the object detecting means and the detection range changing means are activated in case that it is determined that the acceleration is larger than the predetermined value, but in case that it is determined that the acceleration is equal to or smaller than the predetermined value, it is decided that a user is not in motion and operations of the object detecting means and the detection range changing means are stopped. When danger of injury owing to collision, fall or the like is small, the unnecessary functions are thus suspended, thereby reducing power consumption of the mobile apparatus and extending usable hours.

In the eighth invention, upon detection of an object by the object detecting means, an output indicative of this is output. The output is thus output as an indication on the screen, emission of an alarm sound, vibrations of the apparatus itself or otherwise upon detection of the existence of an object, which makes it possible to recognize the existence of an object in the traveling direction of itself without failing even when the pedestrian is concentrated on information which is displayed on the screen, and hence, avoid a dangerous situation.

In the first invention, in the event that a user is walking while looking at the screen on which information is displayed, however the three-dimensional position of the mobile apparatus becomes relative to a vertical direction, it is possible to detect without failing the traveling direction of itself in which the user is walking, and as the direction of detecting the existence of an object is adjusted and made coincide with the traveling direction of itself, it is possible to detect without failing an object which exits in the traveling direction of itself. This makes it possible to recognize the existence of an object, i.e., an obstacle ahead, and therefore, to obviate danger of injury owing to collision, fall, etc.

In the second invention, a pedestrian can detect the existence of an object which exits in the traveling direction of itself while looking at the screen on which information is displayed.

In the third invention, as the direction of emission of the wave which may be an ultrasonic wave for example is adjusted and made coincide with the traveling direction of itself, it is possible to detect the existence of an object which exits in the traveling direction of itself.

In the fourth invention, as the direction of a lens of the imaging means for instance is adjusted and made coincide with the traveling direction of itself, it is possible to detect the existence of an object which exits in the traveling direction of itself.

In the fifth invention, it is possible to accurately extract the horizontal direction component of the detected acceleration of itself and precisely calculate the traveling direction of itself.

In the sixth invention, as the direction of gravity acceleration is precisely specified, it is possible to accurately extract the horizontal direction component of the detected acceleration of itself and precisely calculate the traveling direction of itself.

In the seventh invention, in case that danger of injury owing to collision, fall or the like is small, the unnecessary functions are suspended, thereby reducing power consumption of the mobile apparatus and extending usable hours.

In the eighth invention, the output is thus output as an indication on the screen, emission of an alarm sound, vibrations of the apparatus itself or otherwise upon detection of the existence of an object, which makes it possible to recognize the existence of an object in the traveling direction of itself without failing even when the pedestrian is concentrated on information which is displayed on the screen, and hence, avoid a dangerous situation.

The above and further objects and features of the invention will more fully be apparent from the following detailed description with accompanying drawings.

DETAILED DESCRIPTION OF THE INVENTION

A conventional mobile apparatus as that described above lacks means which senses an object which exists in a traveling direction of itself while considering how a pedestrian holds the mobile apparatus, and therefore, even when combined with a compact object sensor utilizing an ultrasonic wave or the like as that mounted to a vehicle or the like for instance, the mobile apparatus still finds it difficult to sense an object which exists in a traveling direction of itself without failing since the direction of emission of the ultrasonic wave or the like changes every moment, which is a problem.

The present invention has been made in light of this, accordingly aims at providing a mobile apparatus which detects without failing an object which exits in a traveling direction of itself even when a pedestrian is moving while looking at a screen on which information is displayed, and is embodied as described below. The embodiment below is directed to an application of a pronunciation specifying apparatus according to the existence invention to a text-to-speech apparatus.

Figure 1:
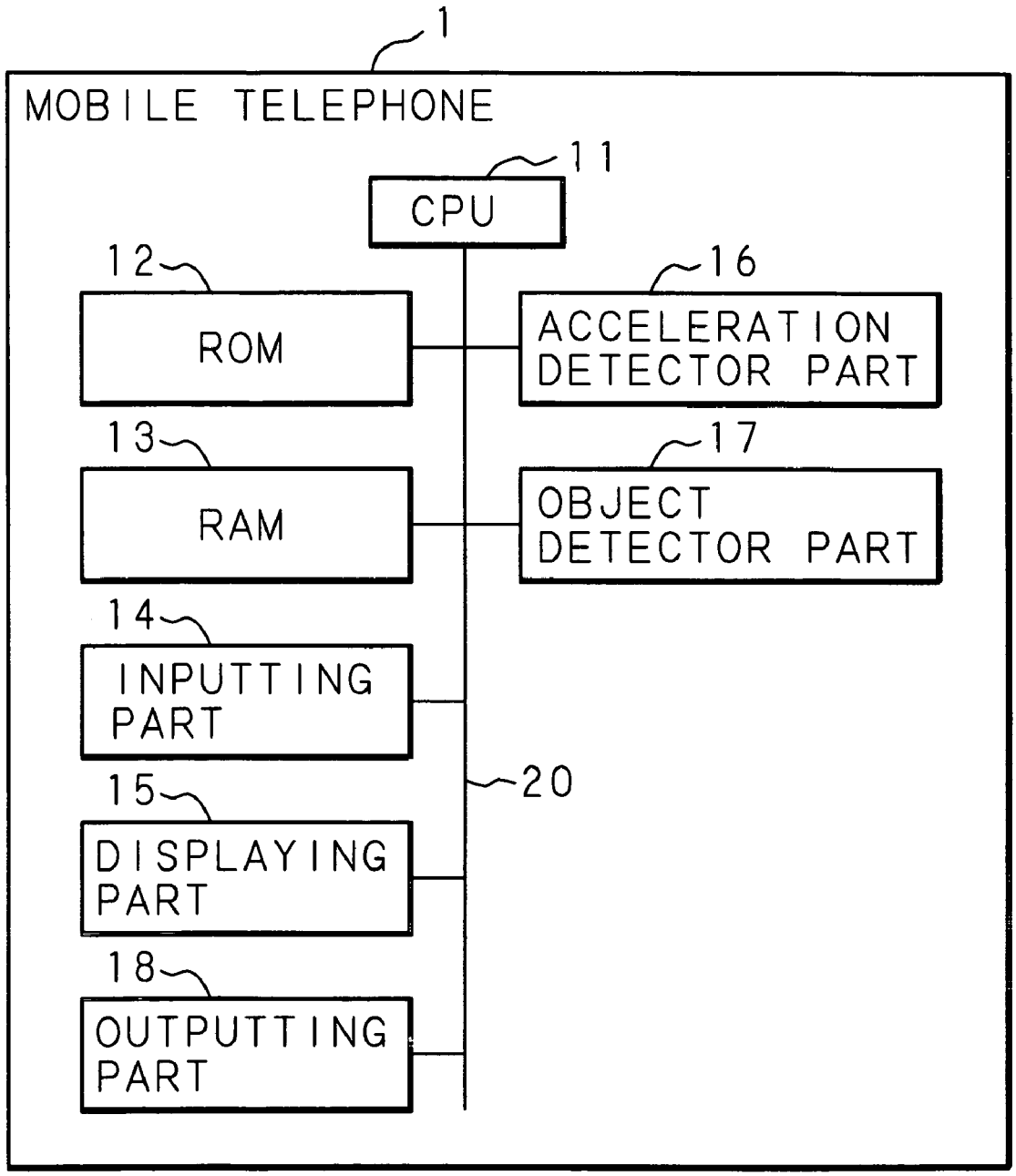
FIG. 1 is a block diagram which shows a structure of a mobile telephone according to an embodiment of the invention.

As the embodiment, an example will now be described that a mobile apparatus is a mobile telephone and a pedestrian is walking while viewing an image which is displayed on a display screen of the mobile telephone. FIG. 1 is a block diagram which shows a structure of a mobile telephone 1 according to an embodiment of the invention.

The mobile telephone 1 according to this embodiment comprises at least a CPU 11, a ROM 12, a RAM 13, an inputting part 14, a displaying part 15, an outputting part 18, an acceleration detector part 16 and an object detector part 17. When a user acquires information using the mobile telephone 1, the user holds the mobile telephone 1 such that the displaying part 15 comprising a screen on which information is displayed and the inputting part 14 on which information is input are opposed against his face.

The CPU 11 is connected with the respective hardware parts described above of the mobile apparatus via an internal bus 20, controls the respective hardware parts above, and executes various software-like functions by means of various types of control programs which are stored in the ROM 12. The RAM 13 is formed by a DRAM or the like, deploys a control program stored in the ROM 12 at the time of execution of the control program, and stores temporary data which are created when the control program is executed.

The inputting part 14 is a button-style inputting apparatus, and accepts inputting of commands for diversified functions in addition to inputting of telephone numbers. The displaying part 15 is a compact display apparatus such as a liquid crystal display panel, and displays various information such as the content of an e-mail. The outputting part 18 is a speaker which outputs an alarm sound, a vibrating part which vibrates.

Figure 2:
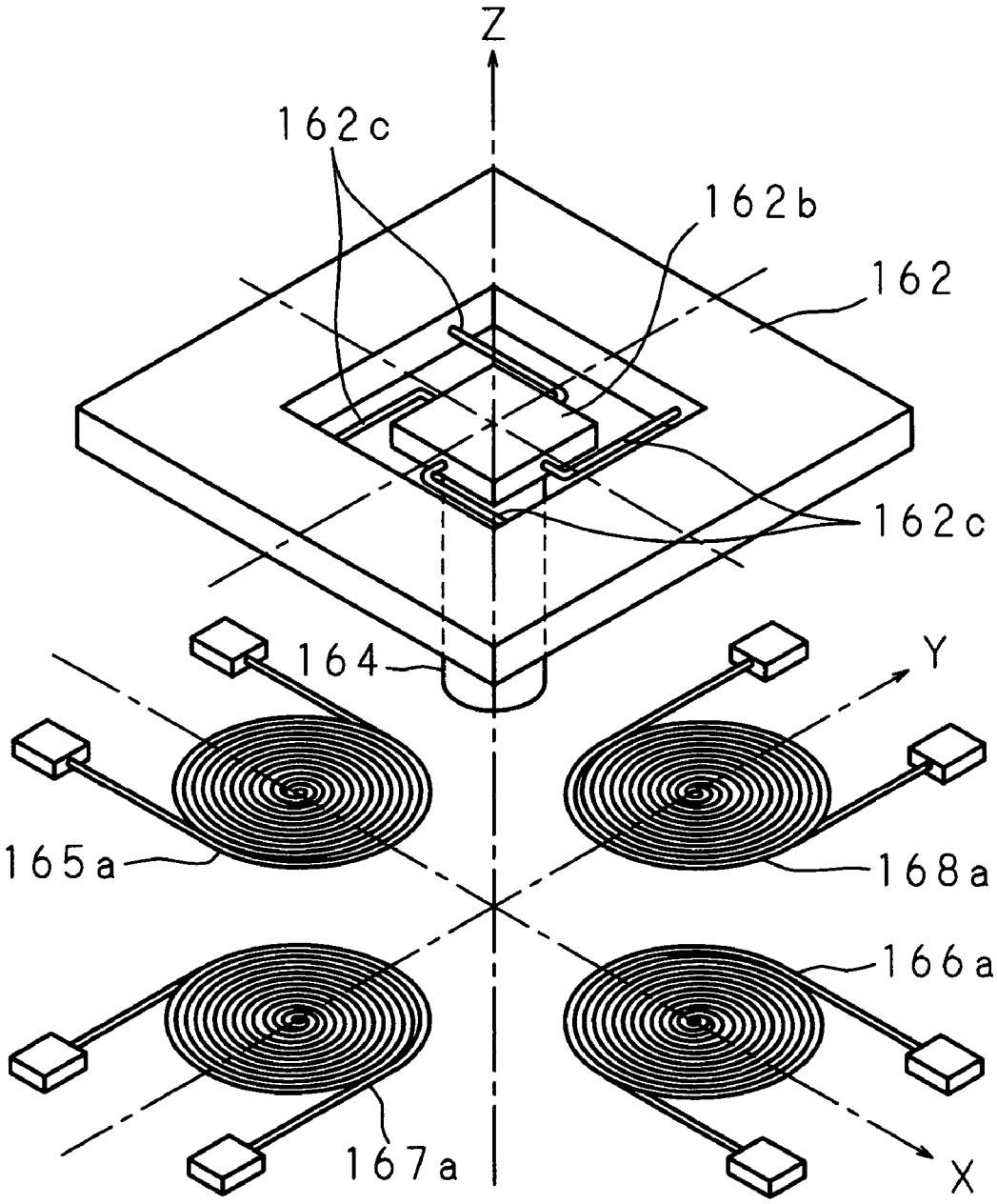
FIG. 2 is a drawing which schematically shows essential portions of an acceleration detector part of the mobile telephone according to the embodiment.
Figure 3:
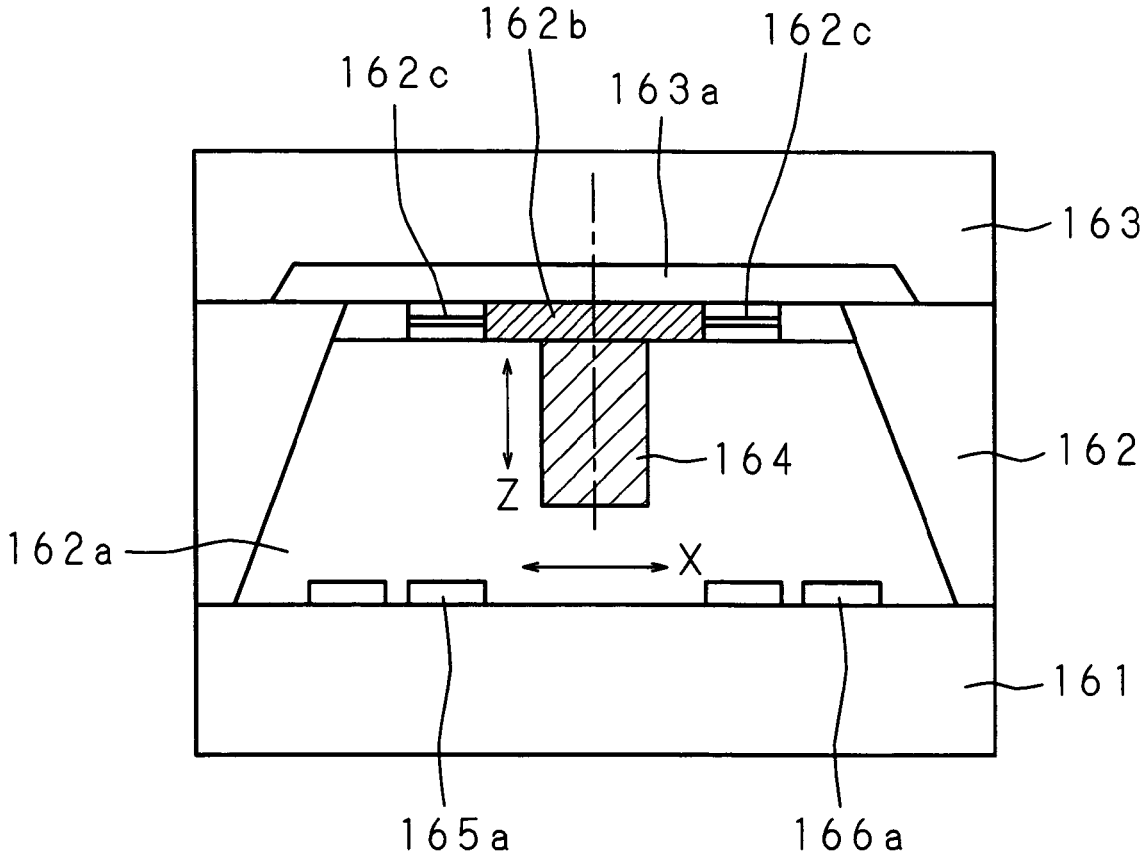
FIG. 3 is a vertical cross sectional view which shows a structure of the essential portions of the acceleration detector part of the mobile telephone according to the embodiment.

The acceleration detector part 16 detects acceleration of the mobile telephone 1 along three axial directions. The three axial directions are a vertical direction (z-axis direction) and directions (x-axis direction and y-axis direction) which are horizontally orthogonal to each other. FIG. 2 is a drawing which schematically shows essential parts of the acceleration detector part 16 of the mobile telephone according to the embodiment, while FIG. 3 is a vertical cross sectional view which shows a structure of the essential portions of the acceleration detector part 16 of the mobile telephone according to the embodiment.

The acceleration detector part 16 has a multi-layer structure comprised of three layers of a bottom layer substrate 161, an intermediate layer substrate 162 and a top layer substrate 163. The bottom layer substrate 161, the intermediate layer substrate 162 and the top layer substrate 163 are formed utilizing semiconductor thin film manufacturing techniques including for instance film deposition techniques, photolithographic techniques and micro-processing techniques such as etching techniques. As the film deposition techniques, a vapor deposition method, a sputtering method, a chemical vapor deposition (CVD) method, a plating method and the like are used. A bulk material such as a thin film or a mono-crystalline silicone wafer formed by these methods is subjected to patterning through photolithography and etching. The etching techniques include ion milling, chemical etching, etc.

The intermediate layer substrate 162 has, in its inside, a hollow part 162*a*, and the top layer substrate 163 has a cavity 163*a* which is a groove part corresponding to the hollow part 162*a*. A trembler 162*b* shaped like a thin film plate is disposed at the border between the hollow part 162*a* and the cavity 163*a* which is the top end of the intermediate layer substrate 162. The trembler 162*b* is a square flat surface as shown in FIG. 2, and stays 162*c* which are L-shaped flat surfaces link central sections of the respective sides of the outer contour of the flat surface to the top end of the intermediate layer substrate 162.

In short, the circumference of the trembler 162*b* is isolated from the top surface of the intermediate layer substrate 162 but is supported by the four stays 162*c*, 162*c*, . . . which easily twist and bend.

As a magnetic substance 164, a permanent magnet is disposed to the bottom surface of the trembler 162*b*. Like the bottom layer substrate 161, the intermediate layer substrate 162 and the top layer substrate 163, the magnetic substance 164 is formed utilizing semiconductor thin film manufacturing techniques or by bonding fine magnets to the trembler 162*b* by gluing, etc.

On the surface of the bottom layer substrate 161, total of four detection elements 165*a*, 166*a*, 167*a* and 168*a* are stacked one atop the other. The detection elements 165*a*, 166*a*, 167*a* and 168*a* are coils, and when the trembler 162*b* vibrates in three dimensions, changes of the magnetic substance 164 change the magnetic field and output voltages are generated which are proportional to a rate at which magnetic fluxes which intersect the respective detection elements have changed with time.

To make it possible for the four detection elements 165*a*, 166*a*, 167*a* and 168*a* to sense three-dimensional changes of the magnetic substance 164, the trembler 162*b*, the magnetic substance 164 and the respective detection elements 165*a*, 166*a*, 167*a* and 168*a* are arranged along the three axial directions, namely, the x-axis direction, the y-axis direction and the z-axis direction which are orthogonal to each other. Hence, when the cylindrical magnetic substance 164 is located at a stationary position (a stop position as it is when no vibrations are applied), the distances along the z-axis direction between the bottom end of the magnetic substance 164 and the respective detection elements 165*a*, 166*a*, 167*a* and 168*a* are the same, and in plan view along the z-axis direction as well, the distances from the origin along the x-axis and the y-axis directions to the center of the respective detection elements 165*a*, 166*a*, 167*a* and 168*a* are equal.

When the three-dimensional position of the mobile telephone 1 changes because of the way the pedestrian holds and operates the mobile telephone 1, the trembler 162*b* of the acceleration detector part 16 vibrates. Due to the inclination of the magnetic substance 164 which is integrated with the trembler 162*b*, the magnetic fluxes of the detection elements 165*a*, 166*a*, 167*a* and 168*a* change, which permits detection of acceleration as variations of the respective output voltages.

Figure 4:
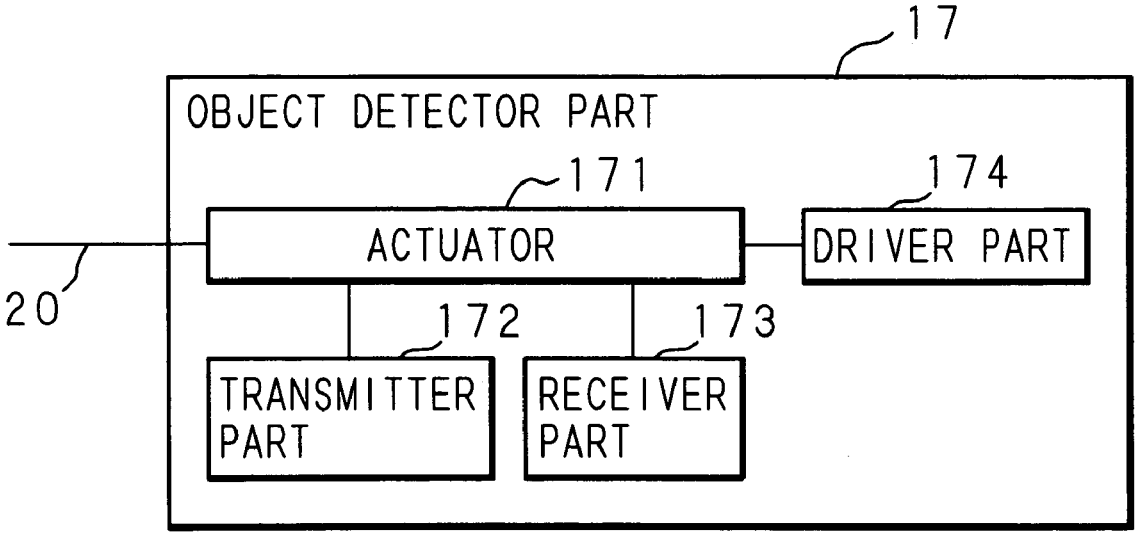
FIG. 4 is a block diagram which shows a structure of essential portions of an object detector part of the mobile telephone according to the embodiment.

The object detector part 17 detects an object which exits within a predetermined range based on a particular direction of the mobile telephone 1. FIG. 4 is a block diagram which shows a structure of essential portions of the object detector part 17 of the mobile telephone 1 according to the embodiment. The object detector part 17 is formed as an ultrasonic sensor and comprises a transmitter part 172 for an ultrasonic wave signal and a receiver part 173 for a reflected wave which are paired, a driver part 174 which controls the directions of the transmitter part 172 and the receiver part 173 which are paired, and an actuator 171 which controls operations of these. The actuator 171 makes the driver part 174 operate in response to a command signal from the CPU 11, thereby changing the directions of the transmitter part 172 and the receiver part 173 which are paired to the traveling direction of itself. The ultrasonic wave from the transmitter part 172 is emitted and dispersed within the predetermined range, an object which exists within this range reflects the ultrasonic wave, and the receiver part 173 receives the reflected wave.

Figure 5:
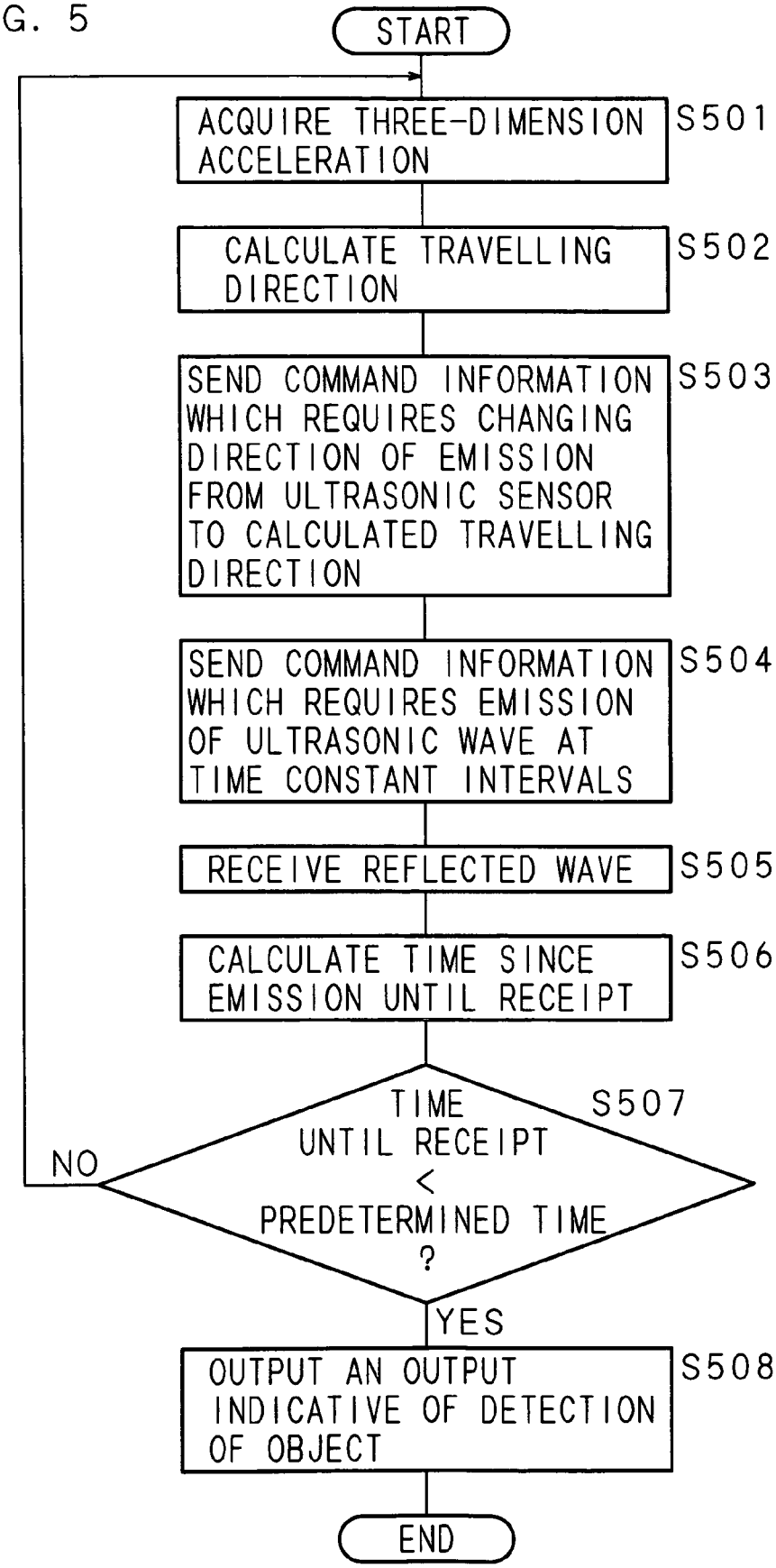
FIG. 5 is a flow chart which shows the sequence of processing in a CPU of the mobile telephone according to the embodiment.

FIG. 5 is a flow chart which shows the sequence of processing in the CPU 11 of the mobile telephone 1 according to the embodiment having the structure above. The CPU 11 of the mobile telephone 1 acquires from the acceleration detector part 16 three-dimensional acceleration, namely, acceleration along the x-axis direction, the y-axis direction and the z-axis direction (Step S501). The CPU 11 calculates the traveling direction of itself from thus acquired three-dimensional acceleration (Step S502).

Figure 6:
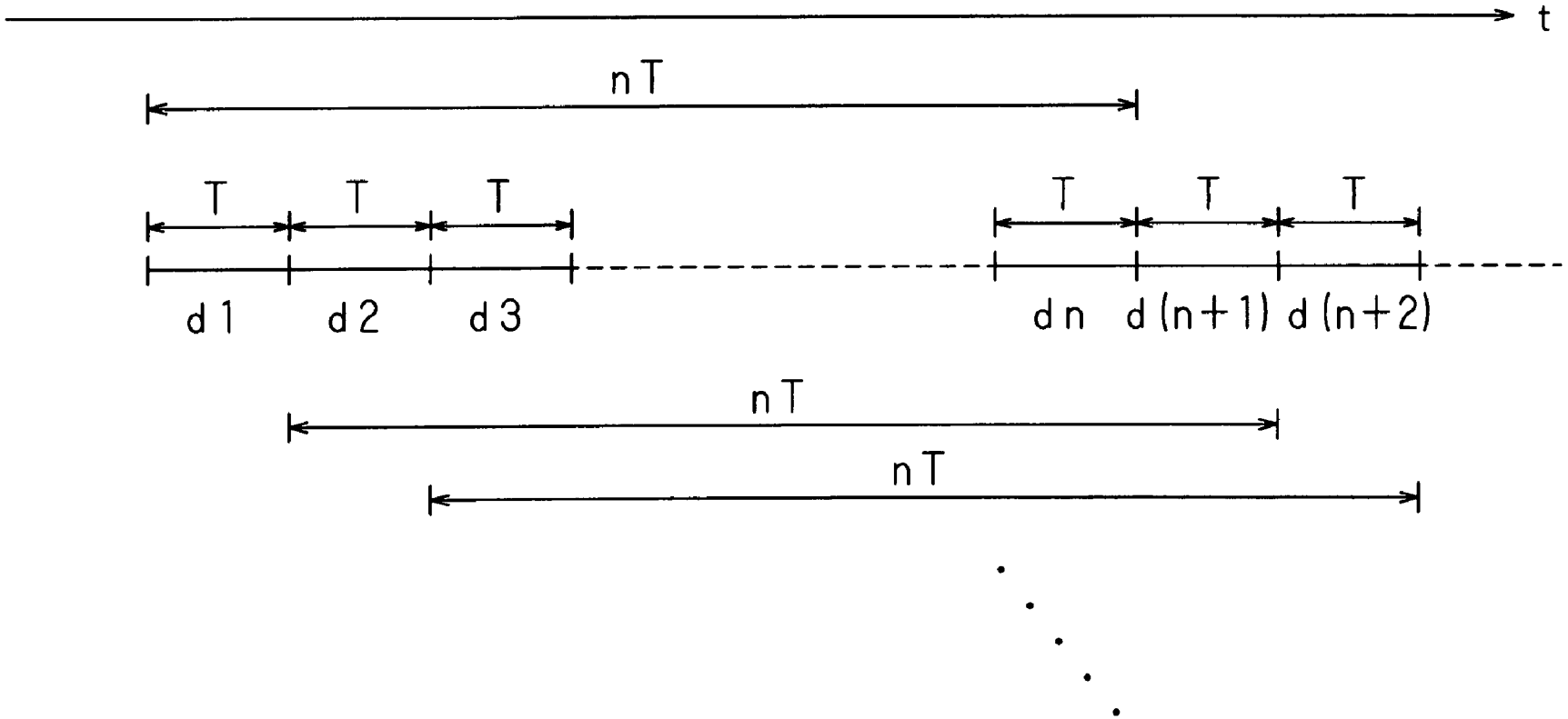
FIG. 6 is an explanatory diagram which shows a method of calculating a traveling direction of itself.

FIG. 6 is an explanatory diagram which shows a method of calculating the traveling direction of itself. For every constant time interval T, directions d1, d2, . . . , dn (n is a natural number) in which acceleration becomes maximum are acquired, and for every period nT (n is a natural number) which is an integer multiple of the time interval T, an average value of the acceleration directions of itself is calculated. For every time T, average values are calculated starting with an average value of d1, d2, . . . , dn (n is a natural number), then an average value of d2, d3, . . . , d(n+1) (n is a natural number), then an average value of d3, d4, . . . , d(n+2) (n is a natural number), and they are determined the traveling direction of itself.

The CPU 11 sends to the actuator 171 command information which requires changing the direction of the transmitter part 172 of the ultrasonic sensor to the calculated traveling direction of itself (Step S503), drives the driver part 174, and adjusts the direction of emission of the ultrasonic wave to the traveling direction of itself. After changing the direction of emission of the ultrasonic wave to the traveling direction of itself, the CPU 11 sends to the actuator 171 command information which requires emission of the ultrasonic wave at constant time intervals (Step S504).

Via the receiver part 173, the CPU 11 receives the reflected wave of the ultrasonic wave emitted from the transmitter part 172 (Step S505), and calculates time since emission of the ultrasonic wave until receipt (Step S506). The CPU 11 determines whether the calculated time until receipt is shorter than a predetermined period of time (Step S507).

When the CPU 11 determines that the time until receipt is equal to or longer than the predetermined period of time (NO at Step S507), the CPU 11 returns to Step S501 and repeats the processing described above. When the CPU 11 determines that the time until receipt is shorter than the predetermined period of time (YES at Step S507), the CPU 11 makes the outputting part 18 output an output indicative of detection of the object in the traveling direction of itself (Step S508).

The object detector part 17 is not limited to a structure which comprises a single ultrasonic sensor, but is preferably a structure which comprises plural ultrasonic sensors for the purpose of specifying the direction in which the existence of an object has been detected. In this case, the actuator can change the receiver part which receives the reflected wave and hence can change the direction of detecting the existence of an object. Further, the range in which detection is possible also expands than where a single ultrasonic sensor is used.

In addition, the object detector part 17 is not limited to an ultrasonic sensor, but may be any sensor which is capable of detecting the existence of an object within a particular range along a particular direction. For instance, the object detector part 17 may comprise an imaging device which captures an image, analyze a captured image and detect the existence of an object. In this case, the actuator can change the direction of a lens of the imaging device.

As for the traveling direction of itself in which a pedestrian is walking, a horizontal direction component may be calculated out of the acceleration of itself detected by the acceleration detector part 16. For accurate detection of the horizontal direction, the mobile telephone 1 internally comprises a compact gyro (rotator) for example, calculates the direction of gravity acceleration from changes of the rotating speed of the gyro, and specifies the horizontal direction as a direction which is perpendicular to the direction of gravity acceleration. Of course, this is not particularly limiting and any method of accurately specifying the horizontal direction may be used instead.

Since the battery capacity of the mobile telephone 1 has a limit, it is preferable to suppress power consumption as much as possible. To this end, the CPU 11 determines whether the absolute value of the acceleration of itself detected by the acceleration detector part 16 is larger than a predetermined value, and when determining that the absolute value is equal to or smaller than the predetermined value, the CPU 11 decides that the mobile telephone 1 is not moving greatly, i.e., that the user is not in motion while bringing the mobile telephone 1 with him, and deprives the object detector part 17 of electric power. As supply of electric power to the object detector part 17 of the mobile telephone 1 is thus stopped when the user is not moving, it is possible to suppress power consumption.

As described above, according to this embodiment, in the event that a user is walking while looking at the screen on which information is displayed, however the three-dimensional position of the mobile telephone 1 becomes along the three axial directions which are orthogonal to each other, it is possible to detect without failing the traveling direction of itself in which the user is walking, and as the direction of detecting the existence of an object is adjusted and made coincide with the traveling direction of itself, it is possible to detect without failing an object which exits in the traveling direction of itself. This makes it possible to recognize the existence of an object, i.e., an obstacle ahead, and therefore, to obviate danger of injury owing to collision, fall, etc.

While the foregoing has described the embodiment in relation to an example that the mobile apparatus is a mobile telephone, the mobile apparatus is not particularly limited to a mobile telephone, but may be any mobile apparatus such as a portable terminal like a PDA and a portable game machine which a user in motion brings with him while looking at a display screen, in which case as well similar effects to those promised by a mobile telephone are attained.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A mobile apparatus which includes a screen on which information is displayed, comprising:

an object detector part for detecting an object which exists within a predetermined range centered around a traveling direction of itself;

an acceleration detector part for detecting acceleration of itself; and a detection range changing part for changing a range in which said object detector part detects the existence of an object, wherein the traveling direction of itself is calculated based on acceleration of itself detected by said acceleration detector part, and said detection range changing part changes the range in which said object detector part detects the existence of an object based on thus calculated traveling direction of itself.

2. The mobile apparatus of claim 1, wherein said object detector part is disposed to the back side of a surface which mounts the screen on which information is displayed.

3. The mobile apparatus of claim 2, wherein said object detector part comprises:

a generator device for emitting a wave;

means for acquiring a reflected wave of the wave emitted by said device; and means for determining whether an object exists or not based on a period of time since emission of the wave until acquisition of the reflected wave, and said detection range changing part changes the direction in which the wave is emitted.

4. The mobile apparatus of claim 3, comprising means which calculates a horizontal direction component based on the acceleration of itself detected by said acceleration detector part.

5. The mobile apparatus of claim 2, wherein said object detector part comprises:

an imaging device for capturing an image;

means for analyzing a captured image; and means for determining whether an object exists or not based on the result of analysis of the image, and said detection range changing part changes the direction in which said imaging device captures images.

6. The mobile apparatus of claim 2, comprising means which calculates a horizontal direction component based on the acceleration of itself detected by said acceleration detector part.

7. The mobile apparatus of claim 2, wherein said object detector part comprises a generator device for emitting a wave; and comprises a processor capable of performing the operations of:

acquiring a reflected wave of the wave emitted by said device: and determining whether an object exists or not based on a period of time since emission of the wave until acquisition of the reflected wave, and the direction in which the wave is emitted is changed.

8. The mobile apparatus of claim 2, wherein said object detector part comprises an imaging device for capturing an image; and comprises a processor capable of performing the operations of:

analyzing a captured image; and determining whether an object exists or not based on the result of analysis of the image, and the direction in which said imaging means captures images is changed.

9. The mobile apparatus of claim 1, wherein said object detector part comprises:

a generator device for emitting a wave;

means for acquiring a reflected wave of the wave emitted by said device; and means for determining whether an object exists or not based on a period of time since emission of the wave until acquisition of the reflected wave, and said detection range changing part changes the direction in which the wave is emitted.

10. The mobile apparatus of claim 9, comprising means which calculates a horizontal direction component based on the acceleration of itself detected by said acceleration detector part.

11. The mobile apparatus of claim 1, wherein said object detector part comprises:

an imaging device for capturing an image;

means for analyzing a captured image; and means for determining whether an object exists or not based on the result of analysis of the image, and said detection range changing part changes the direction in which said imaging device captures images.

12. The mobile apparatus of claim 1, comprising means which calculates a horizontal direction component based on the acceleration of itself detected by said acceleration detector part.

13. The mobile apparatus of claim 12, comprising a gyro sensor which measures the rotating speed of an object, wherein the horizontal direction is calculated.

14. The mobile apparatus of claim 13, comprising:

means for determining whether the acceleration of itself detected by said acceleration detector part is larger than a predetermined value; and means for activating said object detector part and said detection range changing part in case that said means above determines that the acceleration is larger than said predetermined value but stops operations of said object detector part and said detection range changing part in case that said means above determines that the acceleration is equal to or smaller than said predetermined value.

15. The mobile apparatus of claim 13, comprising means for outputting an output indicative of the existence of an object in case that said object detector part has detected the existence of the object.

16. The mobile apparatus of claim 12, comprising:

means for determining whether the acceleration of itself detected by said acceleration detector part is larger than a predetermined value; and means for activating said object detector part and said detection range changing part when said means above determines that the acceleration is larger than said predetermined value but stops operations of said object detector part and said detection range changing part in case that said means above determines that the acceleration is equal to or smaller than said predetermined value.

17. The mobile apparatus of claim 16, comprising means for outputting an output indicative of the existence of an object in case that said object detector part has detected the existence of the object.

18. The mobile apparatus of claim 12, comprising means for outputting an output indicative of the existence of an object in case that said object detector part has detected the existence of the object.

19. The mobile apparatus of claim 1, wherein said object detector part comprises a generator device for emitting a wave; and comprises a processor capable of performing the operations of:

acquiring a reflected wave of the wave emitted by said device: and determining whether an object exists or not based on a period of time since emission of the wave until acquisition of the reflected wave, and the direction in which the wave is emitted is changed.

20. The mobile apparatus of claim 1, wherein said object detector part comprises an imaging device for capturing an image; and comprises a processor capable of performing the operations of:

analyzing a captured image; and determining whether an object exists or not based on the result of analysis of the image, and the direction in which said imaging means captures images is changed.

* * * * *